US005303765A

United States Patent [19]

Pearson et al.

[11] Patent Number: 5,303,765

[45] Date of Patent: Apr. 19, 1994

[54] ROLL CASTING MACHINE

[75] Inventors: William J. Pearson, Poole; John D. Hunt, North Leigh, both of United Kingdom

[73] Assignee: Davy McKee (Poole) Limited, Dorset, England

[21] Appl. No.: 916,100

[22] PCT Filed: Feb. 15, 1991

[86] PCT No.: PCT/GB91/00231

§ 371 Date: Sep. 11, 1992

§ 102(e) Date: Sep. 11, 1992

[87] PCT Pub. No.: WO91/12101

PCT Pub. Date: Aug. 22, 1991

[30] Foreign Application Priority Data

Feb. 19, 1990 [GB] United Kingdom ..... 9003699

[51] Int. Cl.[5] ..... B22D 11/06

[52] U.S. Cl. ..... 164/428; 164/480

[58] Field of Search ..... 164/428, 480, 154, 451, 164/452

[56] References Cited

U.S. PATENT DOCUMENTS 4,577,672 3/1986 Frischknecht et al. ..... 164/428

FOREIGN PATENT DOCUMENTS 58-221646 12/1983 Japan ..... 164/452

*Primary Examiner*—Kuang Y. Lin

*Attorney, Agent, or Firm*—Lee, Mann, Smith, McWilliams, Sweeney & Ohlson

[57] ABSTRACT

A roll caster comprising a pair of rotatable rolls (1, 2), and mounting means (4, 5) for moving one of the rolls towards and away from the other, so as to adjust the gap between the rolls. A nozzle assembly (9) for directing molten metal into the gap between the rolls, is mounted with its outlet end projecting into the gap, with a suitable clearance. The nozzle assembly is mounted on a carrier (13) which is moved in accordance with the movement of the rolls, by means of a mounting comprising movable links (16, 17) so as to maintain the required clearance between the nozzle and the rolls.

8 Claims, 4 Drawing Sheets

ROLL CASTING MACHINE

This invention relates to a roll casting machine which comprises essentially a pair of cooled rotatable rolls and a nozzle assembly having its outlet end projecting into the gap between the rolls whereby, in use, molten metal is directed from the outlet end of the nozzle into the gap to be cooled by the rolls and to be shaped into the form of strip.

Such casting machines are well known and the nozzle is positioned with its outlet end projecting into the gap close to the position of minimum separation between the rolls.

According to the present invention, a roll caster comprises a pair of rotatable rolls; means for moving one of the rolls towards and away from the other roll to adjust the gap therebetween; a nozzle assembly having an outlet end projecting into the gap with clearance between the outlet end of the nozzle and the rolls; and means for causing the nozzle to be moved into and out of the gap to maintain clearance between the nozzle and the rolls as the gap is adjusted.

Conveniently, the nozzle assembly is mounted on a carrier which is pivotally located on pairs of links and the carrier is caused to pivot on said links to direct the nozzle assembly towards and away from the rolls. The carrier is pivoted by means dependent upon the separation of the rolls.

In one embodiment of the invention, physically displacing the movable roll is used to mechanically displace the carrier whilst, in another embodiment of the invention, a signal dependent upon the separation of the rolls is employed to control an actuator such as a hydraulic piston-cylinder device or a stepper motor which causes the carrier to pivot.

BRIEF DESCRIPTION OF THE DRAWINGS

In order that the invention may be more readily understood, it will now be described, by way of example only, with reference to the accompanying drawings, in which.

DETAILED DESCRIPTION OF THE DRAWINGS

Figure 2:
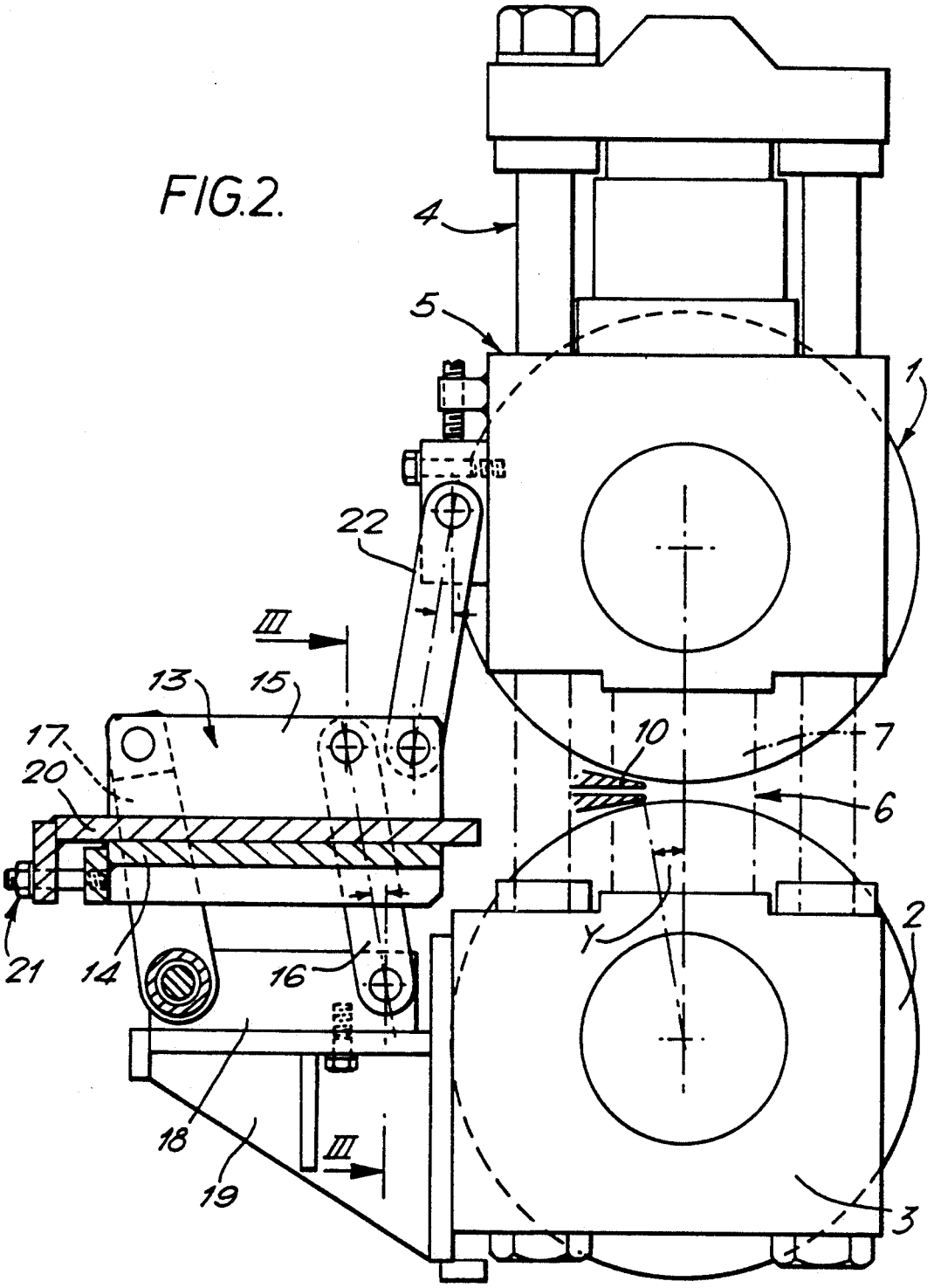
FIG. 2 shows the embodiment of FIG. 1 in more detail.

A pair of rolls 1, 2 are arranged one above the other with their longitudinal axes of rotation horizontal. The lower roll 2 is mounted at its ends in bearing clock assemblies 3 which are secured in a housing structure, indicated generally by reference 4 in FIG. 2. The upper roll 1 is similarly mounted at its ends in bearing chock assemblies 5 which are also supported in the housing structure 4. However, the chocks 5 and, hence, the roll 1 are displaceable within the housing structure in order to adjust the gap 6 between the rolls. Means (not shown) are provided for adjusting the top roll with respect to the lower roll and a position transducer 7, shown in FIG. 2, is arranged between the chocks in order to indicate the size of the gap between the rolls.

A nozzle assembly 9 is arranged with its longitudinal axis substantially horizontal and its outlet end 10 projects as far into the gap as is possible whilst maintaining clearance between the outlet end of the nozzle and the rolls.

In use, molten metal is passed from a tundish, indicated generally by reference 12, into the nozzle and is directed from the outlet end of the nozzle into the gap between the rolls. The rolls are cooled by means (not shown) so that, as the molten metal comes into contact with the periphery of the rolls, it is cooled to form a flat strip.

The nozzle assembly and the tundish are mounted on a support carrier 13. The carrier comprises a plate 14 which extends between a pair of side walls 15 which together constitute a channel-shaped carrier for supporting the nozzle assembly. Each of the side walls 15 is pivoted at its forward and rear ends to forward and rear links 16, 17, respectively. The lower ends of these links are, in turn, pivotally secured to fixed blocks 18 mounted on a support bracket 19 projecting from the housing structure 4. The links 16, 17 are such that the carrier 13 is pivoted towards or away from the rolls 1, 2. Consequently, when the casting nozzle is supported on the carrier, the outlet end of the nozzle can be directed into and out of the gap 6 between the rolls. The nozzle assembly is mounted on a plate 20 which is adjustable in its longitudinal direction with respect to the plate 14 by means of an adjusting screw mechanism 21.

In the arrangement shown in FIG. 2, the tip of the outlet end of the nozzle is separated from the vertical plane joining the centres of the two rolls 1, 2 by an angle Y of approximately 10°. The inclination of the links 16, 17 to the vertical is also arranged to be approximately 10°.

Figure 1:
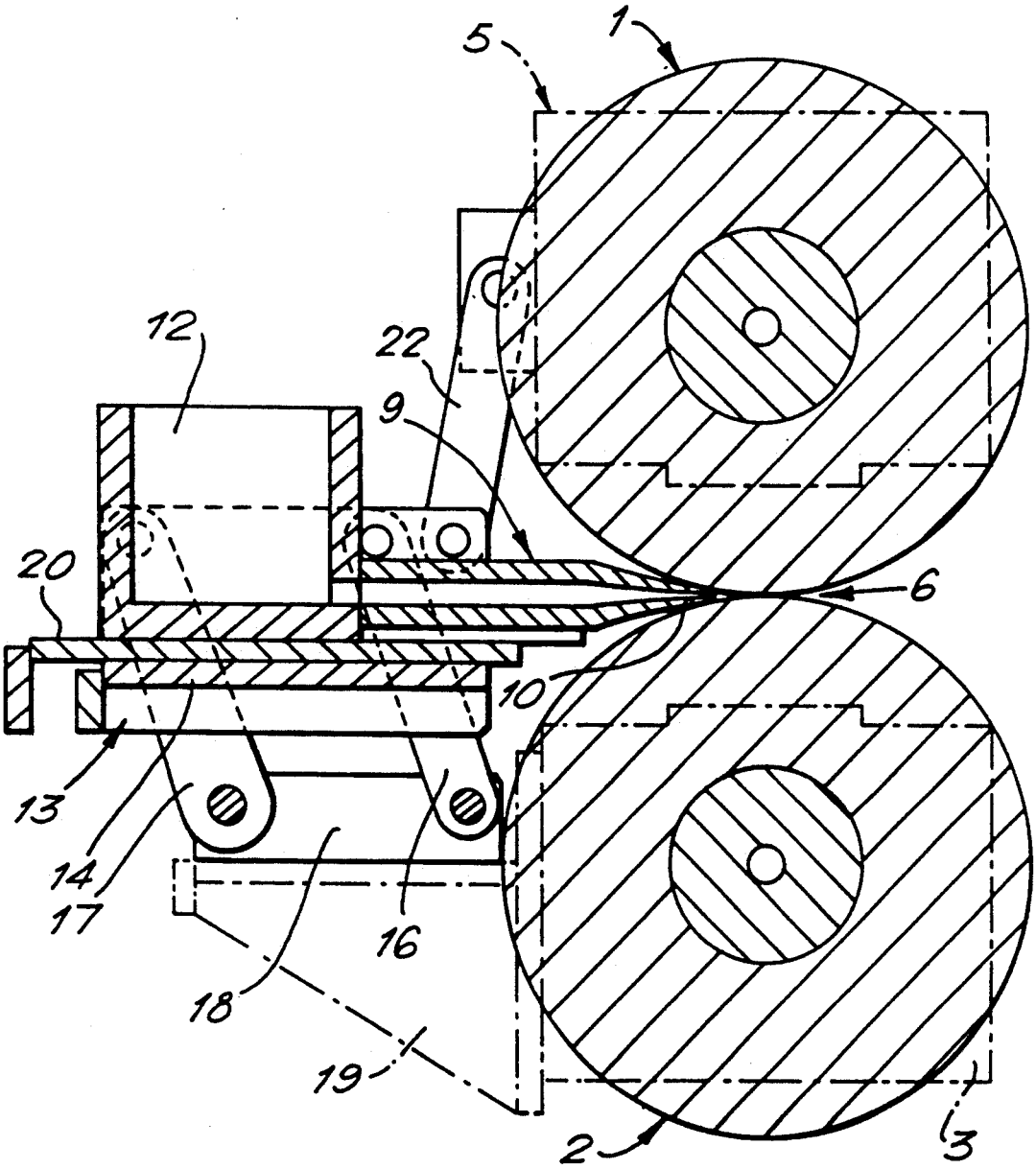
FIG. 1 shows diagrammatically a first embodiment of the invention.
Figure 3:
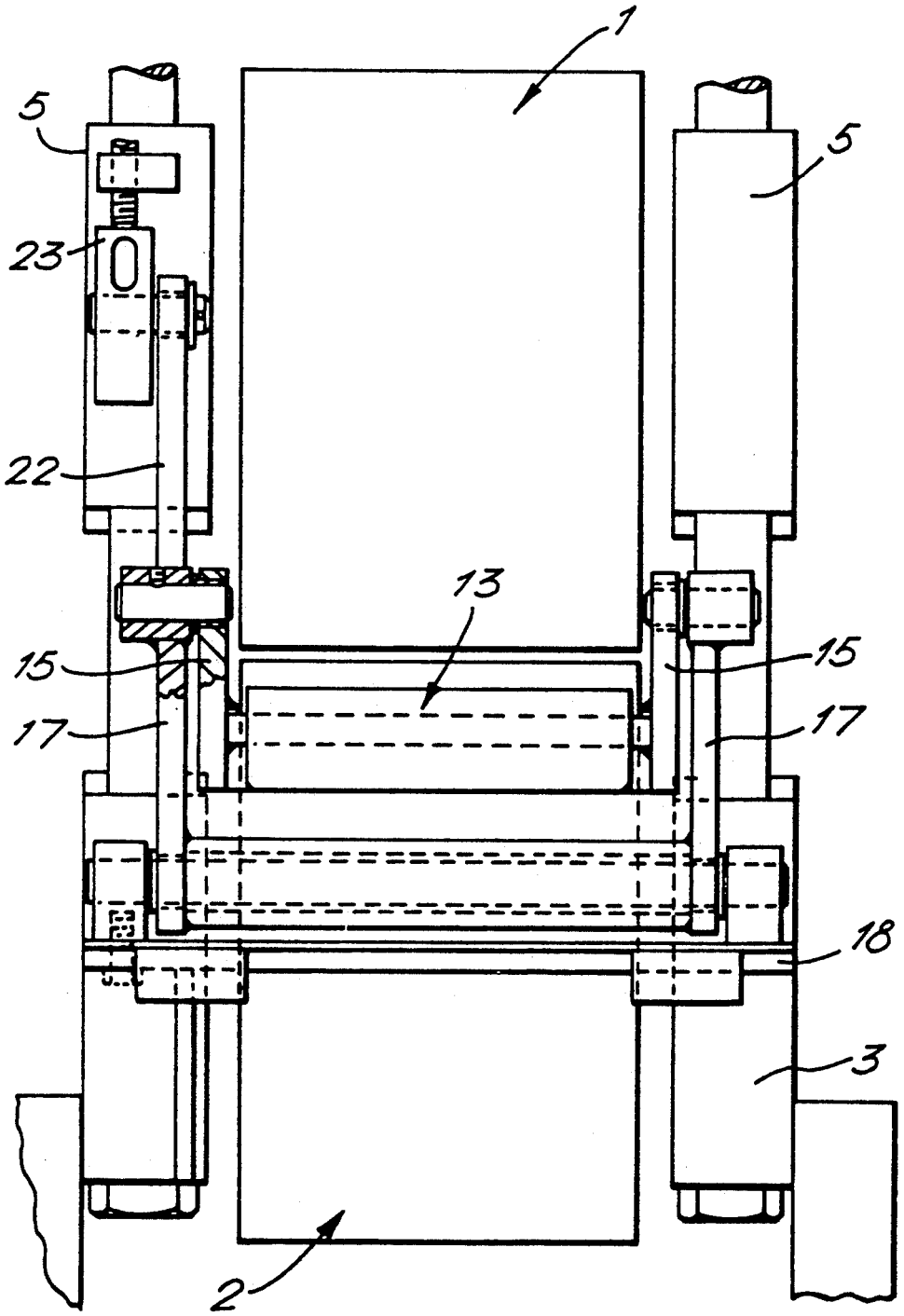
FIG. 3 is a view on the line III—III of FIG. 2.

In the arrangement shown in FIGS. 1-3, a further link 22 is pivotally connected to a side wall of the carrier and to the chock 5 of the upper roll. Again, the inclination of the link 22 to the vertical is approximately 10°. The upper end of the link 22 is pivotally connected to a block 23 mounted on the side wall of the upper chock and the block is adjustable with respect to the chock so that the angle of inclination of the link 22 can be made substantially equal to the inclination of the links 16, 17.

In use, as the upper roll is displaced towards and away from the lower roll in order to adjust the gap between them, the nozzle is automatically displaced so that the tip of the nozzle maintains a clearance between the rolls. From the position shown in FIG. 2, if the upper roll 1 is raised in order to increase the gap between itself and the fixed roll 2, the link 22 pivots in an anticlockwise direction causing the carrier 13 to move towards the rolls and, hence, the tip of a nozzle outlet supported on the carrier moves further into the gap between the rolls. On the other hand, if the top roll is moved towards the lower roll, the link 22 pivots in a clockwise direction withdrawing the carrier 13 and, hence, the nozzle away from the rolls so that clearance is maintained between the tip of the nozzle and the rolls.

Figure 4:
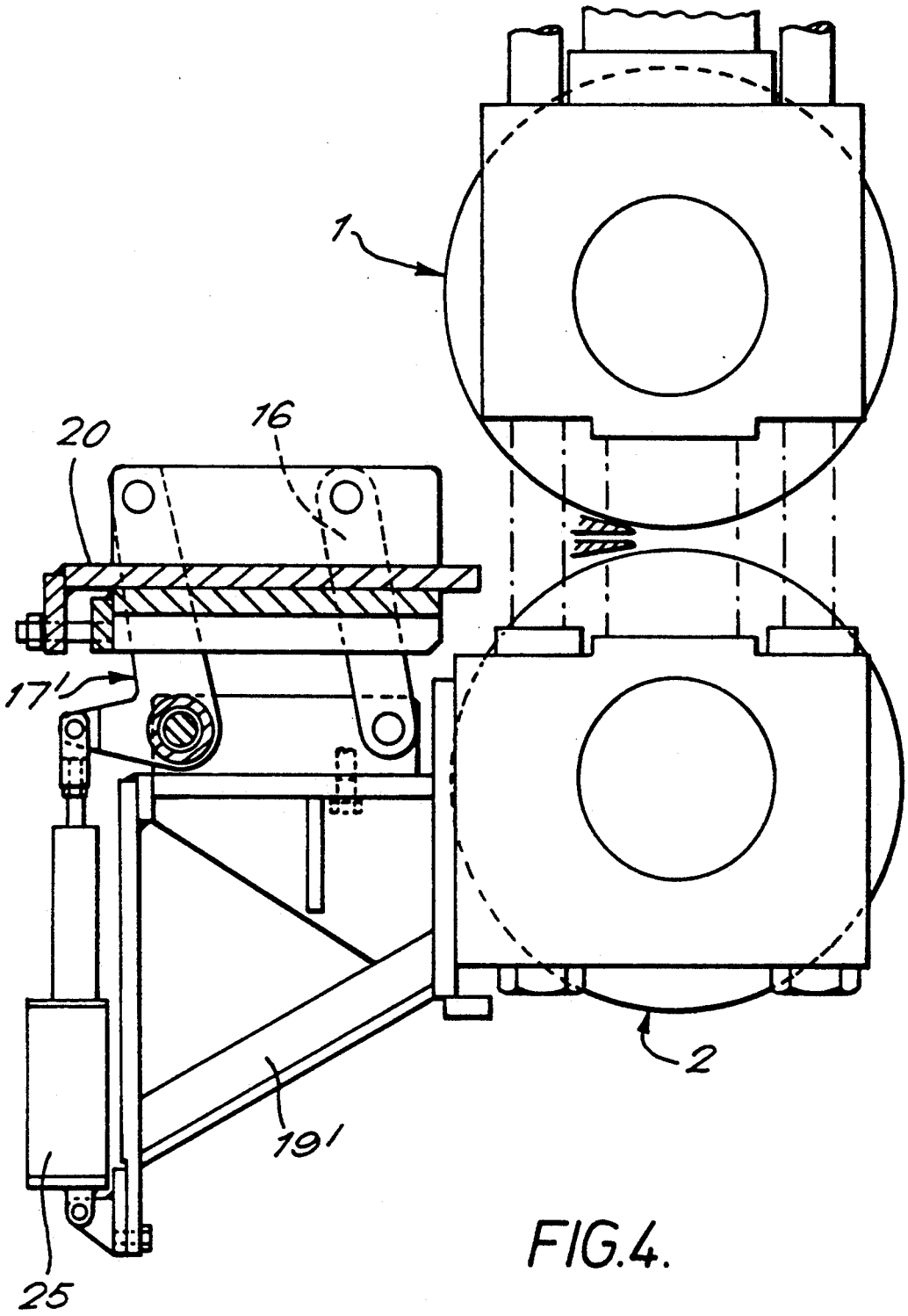
FIG. 4 is a side elevation, partly in section, showing an alternative embodiment of the invention.

In the alternative arrangement shown in FIG. 4, the link 22 between the carrier and the top chock of the previously described embodiment is omitted and the links 17' are each in the form of a bell crank lever. A linear actuator 25 is mounted on a modified support bracket 19' and the piston of the actuator is connected to one of the bell crank levers. These levers are connected together so that, on actuating the actuator, the carrier is pivoted so that the tip of the nozzle moves into or out of the gap 6 between the rolls. The linear actuator 25 is controlled by the position transducer in such a manner that, as the transducer detects a narrowing of the roll gap, the actuator is operated to withdraw the nozzle from the gap, and, when the position transducer detects an increase in the width of the gap between the rolls, the nozzle is pushed further into the gap whilst still maintaining clearance between the tip of the nozzle and the rolls.

It has been found to be more convenient if the whole casting machine is inclined by a small angle of, say, 16 degrees to the vertical so that the outlet end of the nozzle is directed slightly upwardly into the gap between the rolls. Alternatively, the arrangement may be such that casting takes place in a generally downward direction, by arranging the rolls next to one another in approximately the same horizontal plane.

We claim:

1. A roll caster comprising a pair of rotatable rolls (1, 2), means for moving one of the rolls (1) towards and away from the other roll (2) to adjust the gap (6) therebetween, a nozzle assembly having an outlet end (10) projecting into the gap (6) with clearance between the outlet end (10) of the nozzle and the rolls (1, 2); and means for causing the nozzle to be moved into and out of the gap (6) to maintain clearance between the nozzle and the rolls (1, 2) as the movable roll (1) is moved to adjust the gap (6) characterized in that said roll caster further comprises means for associating said nozzle and said movable roll such that the nozzle moving means is automatically responsive to the movement of the movable roll (1) to maintain the clearance.

2. A roll caster according to claim 1 in which the nozzle moving means comprises a carrier (13) for the nozzle assembly, the carrier (13) being mounted on a pivoting link mechanism and means for moving the link mechanism to move the carrier (13) towards and away from the rolls (1, 2).

3. A roll caster according to claim 2 further comprising adjustment means (21) between the nozzle and the carrier (13), for adjusting the position of the nozzle relative to the carrier (13).

4. A roll caster according to claim 1 in which the means for moving the link mechanism comprises a mechanical connection between the carrier (13) and the movable roll (2) to provide said associating means.

5. A roll caster according to claim 4 in which the mechanical connection includes at least one link connected between the carrier (13) and the movable roll (2).

6. A roll caster according to claim 1 in which the means for moving the carrier comprises an actuator (25), and said associating means is responsive to the roll motion to provide a control signal for controlling said actuator (25), in accordance with the size of the roll gap.

7. A roll caster according to claim 5 comprising means (23) for adjusting the link mechanisms so as to set the angles of the links equal to one another relative to the center-line of the gap (6), whereby the nozzle is maintained in alignment with the gap (6) as the gap (6) is adjusted.

8. A roll caster according to claim 7 in which the pivoting link mechanism comprises a first pair of links (16, 17) providing a parallelogram like mechanism pivotally linking the carrier (3) to a chock supporting one of the pair of rolls (1, 2) and a second link pivotally linking the carrier to a chock supporting the other of the pair of rolls (1, 2).

* * * * *